US007350636B2

(12) United States Patent
Smith et al.

(10) Patent No.: US 7,350,636 B2
(45) Date of Patent: Apr. 1, 2008

(54) DOOR ASSEMBLY FOR A CHUTE SYSTEM

(75) Inventors: Fred P. Smith, Alpine, UT (US); Todd R. Mendenhall, Riverton, UT (US); Hadi C. Boustani, Bethesda, MD (US)

(73) Assignee: Chutes International Manufacturing, LLC, White Plains, MD (US)

( * ) Notice: Subject to any disclaimer, the term of this patent is extended or adjusted under 35 U.S.C. 154(b) by 232 days.

(21) Appl. No.: 11/237,151

(22) Filed: Sep. 28, 2005

(65) Prior Publication Data

US 2006/0064935 A1 Mar. 30, 2006

Related U.S. Application Data

(60) Provisional application No. 60/613,422, filed on Sep. 28, 2004.

(51) Int. Cl.
*B65G 11/16* (2006.01)

(52) U.S. Cl. ..... 193/33; 193/34

(58) Field of Classification Search ..... 193/2 R, 193/31 A, 33, 34; 49/281, 371, 394, 398, 49/381, 333

See application file for complete search history.

(56) References Cited

U.S. PATENT DOCUMENTS

| | | | | |
|---|---|---|---|---|
| 1,789,123 | A * | 1/1931 | Triggs | 193/33 |
| 3,095,073 | A * | 6/1963 | Larson et al. | 193/33 |
| 5,020,651 | A | 6/1991 | Lockett | |
| 6,062,368 | A | 5/2000 | Kamm | |
| 6,186,306 | B1 | 2/2001 | Kamm | |
| 6,269,928 | B1 | 8/2001 | Kamm | |
| 7,017,728 | B2 * | 3/2006 | Nyquist | 193/33 |

* cited by examiner

*Primary Examiner*—James R. Bidwell
(74) *Attorney, Agent, or Firm*—Sand & Sebolt

(57) ABSTRACT

A door assembly for a chute system comprising a door pivotally connected to a frame assembly mountable around an opening in a chute system. The door is manufactured from stainless steel and is free of welds. The door includes an automatic closer mounted to its interior surface and being directly connected to the frame assembly at one end and to the door at the other end. When the door is opened, the closer moves with the door out of the opening to the chute system, thereby increasing the usable space for inserting articles into the chute. The closer does not intrude into the interior of the chute when the door is in a closed position. The door may also include a deflector plate mounted proximate the door hinge to protect the hinge and prevent debris from articles inserted into the chute from dropping into the gap between the door and frame and interfering with the action of the hinge.

27 Claims, 12 Drawing Sheets

DOOR ASSEMBLY FOR A CHUTE SYSTEM

CROSS-REFERENCE TO RELATED APPLICATIONS

This application claims priority from U.S. Provisional Patent Application Ser. No. 60/613,422; filed Sep. 28, 2004, the entire disclosure of which is incorporated herein by reference.

BACKGROUND OF THE INVENTION

1. Technical Field

This invention generally relates to a door assembly. More particularly, the invention relates to a fire-rated door assembly for a chute system. Specifically, the invention relates to a door assembly which includes a weld-free door having an automatic door closer mounted on the interior surface thereof and which includes a deflector plate for covering the door hinge during operation.

2. Background Information

In tall building structures like apartments or office buildings, it is common to provide chute systems which are used by the occupants of the building to dispose of trash or to send laundry to lower floors in the building.

The chute systems generally consist of a large, vertically-oriented main chute that has a plurality of branches, each of which originates in an opening on one of the individual levels of the building structure. Each opening to the chute system is provided with a door to cover that opening when the chute is not in use. The occupant can open the door and place a bag of garbage or laundry, for example, through the opening and then release the bag. The bag slides down the chute branch to the main chute and then drops or slides downwardly to a collection bin disposed a spaced number of floors away from the opening in question.

The door that covers the opening to the chute branch has to meet certain safety requirements and standards. One of those requirements is that the chute door must close automatically when released. Furthermore, the door must meet UL (Underwriters Laboratory Inc.) fire codes to attempt to prevent any fires from spreading from one floor of a building to another through the chute system.

Currently known chute door designs typically include a recessed frame that fits inside the chute opening and serves as mounting structure for the chute door. Furthermore, chute doors that are presently known in the art generally use fairly complex systems of linkages to shut the door once it is released. The inclusion of the linkage is usually a result of trying to maximize the angle of door opening while preserving the self-closing feature of the door. Other designs, such as those of U.S. Pat. Nos. 6,062,368; 6,186,306 and 6,269,928 utilize the linkages to both close the door and provide auxiliary functions such as automatic locking. The linkage and closer assemblies used in the prior art are typically mounted inside the chute or on the frame on one side of the door in order to meet the code requirements and reduce the possibility of contamination of the linkages and closer assemblies.

The aforementioned usage of linkage and closer assemblies results in deficiencies in currently known chute doors. The mounting of the linkage and closer assembly in the chute or on the side of the door takes up significant space in the chute opening and reduces the usable area of the opening for disposable of articles therethrough. When the linkage and closer assemblies are placed to the side of the door, the width of the door is necessarily decreased to allow for installation into a fixed width chute opening. Thus, the door size and the usable chute opening are both reduced. Currently known designs also have the linkages and closer attached to the frame inside the chute. As the door is opened, the mechanism remains essentially in the same position, namely inside the chute and obstructing a portion of the opening. Furthermore, the closer assembly is typically the highest maintenance and replacement item for chute doors. When the closer is fixedly mounted to a structure inside the chute, it can be difficult to access, remove and reinstall. Some known designs therefore require that the entire door assembly be pulled out of the chute for maintenance of the closer assembly.

A second deficiency in the currently known art relates to the actual installation of the door. The chute system is typically installed in the building before the finishing of the interior surfaces and installation of the chute doors. Variations in wall thickness, chute opening size, squareness of the opening etc., can require modifications to the door assembly to achieve a proper fit and function of the door. The safety standards and ratings of these types of doors require fairly precise fits and connections which may be compromised by the typical variations found in rough construction. The result is often a need to custom fit each door installation with field-cuts or modifications in order to get the door assembly to fit into rough construction. This obviously leads to an increase in the number of man hours such an installation procedure costs and therefore leads to an increase in the total cost of installation of a chute system into a building structure. Furthermore, if the installation requires field modifications, the fit and alignment of the finish frame can be adversely affected and result in an aesthetically displeasing door assembly.

Previously known doors are manufactured with the interior surfaces of the door being made of cheaper materials such as aluminized or galvanized steel and having typically been welded together. The applicant has recognized that both the type of steel used and the presence of welds tends to increase the risk of contamination of the door surfaces. This risk of contamination increases because aluminized or galvanized steel may react with accidentally spilled materials and liquids resulting in early deterioration of the interior door surface. Furthermore, welds tend to have small pitted areas therein and consequently debris from the garbage can accumulate in both the welded areas and on the deteriorating surfaces, thus allowing bacterial colonies to flourish on the door.

There is therefore a need in the art for a door assembly for a chute system that is capable of meeting regulations and codes governing this type of installation; that is easy to install and maintain, that tends to reduce the potential for contamination of the door and yet leaves the maximum amount of space available in the opening in order to allow articles to be inserted therethrough and be deposited into the chute.

SUMMARY OF THE INVENTION

Consistent with the foregoing objects, and in accordance with the invention as embodied and broadly described herein, a method and apparatus are disclosed in one embodiment of the present invention as including a chute door with external mounting frame and a direct acting automatic closer.

It is therefore an object of the present invention to provide a chute door that meets existing codes and standards such as fire ratings.

A further object of the present invention is to provide a chute door that maximizes the usable area of the chute opening.

Another object of the present invention is to provide a chute door that accommodates the inaccuracies of rough opening upon installation without the need for special modifications.

Another object of the present invention is to provide a chute door that facilitates access to the closer for maintenance and repair.

Another object of the present invention is to provide a chute door that is simple in design and economical to produce.

The door assembly of the present invention includes a frame assembly comprising a separate mounting frame and finish frame for a chute door. An automatic door closer is attached to the frame assembly at one end and to the door at the other end. The automatic closer acts directly on the door and is mounted directly on the interior surface of the door. The closer therefore does not occupy part of the chute opening when the door is open because it moves with the door into and out of the opening to the chute. The door is fabricated with a flange of material that overlaps the trim frame externally to provide a seal for the chute opening. The mounting frame has slotted holes on first legs thereof to facilitate installation and adjustments of the door and frame assembly to the chute system. The first legs of the mounting frame are longer and the slotted holes facilitate the mounting and adjusting of the door assembly to fit the chute opening. The finish frame can be properly fitted independently of the mounting frame so that the adjustments made during installation do not affect the visible frame on the exterior of the wall. The use of separate mounting frames and trim frames increases the ease with which the door assembly can be installed and therefore tends to reduce the costs associated therewith.

The present invention tends to overcome the previously stated problems with the prior art by not using linkages for the closer, by having an easily removable closer cover for easier access to the closer for maintenance and by having longer first legs on the mounting frame with slotted fastener points to allow for adjustment of the positioning of the mounting frame during installation.

The present invention tends to not narrow the chute opening because of the type of closer that is utilized to automatically close the door and because that automatic closer is mounted to the interior surface of the door. Preferably the closer comprises a mechanical coil spring which includes dampening hydraulic fluid or, alternatively, a gas spring. Additionally, the closer moves with the door in and out of the opening. Consequently, when the door is opened the usable space is maximized. Furthermore, the closer does not protrude into the vertical portion of the chute when the door is in a closed position. It should be noted that chute systems can vary in size and consequently it is sometime necessary to use fairly large door assemblies to close larger chute openings. In these larger door assemblies, more than one automatic closer can be utilized to close the door. This can be accomplished by mounting a second stop plate, automatic closer and cover on the interior surface of the door. The two stop plates, closers and related covers are mirror images of each other.

When the door is opened, the closer is easily accessed for maintenance as it lies outside of the chute and the only step required to reach it is the removal of the protective cover. With the cover removed, the automatic closer can be adjusted, removed or replaced. This increases the ease with which the automatic closer can be maintained and reduces the costs associated therewith.

Furthermore, the door is provided with a deflector plate for protecting the door hinge and thereby reducing the possibility for debris to accumulate in the gap between the door and frame assembly. This also reduces the possibility of that the door will not close properly because debris has become trapped in that gap and is interfering with the operation of the hinge.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
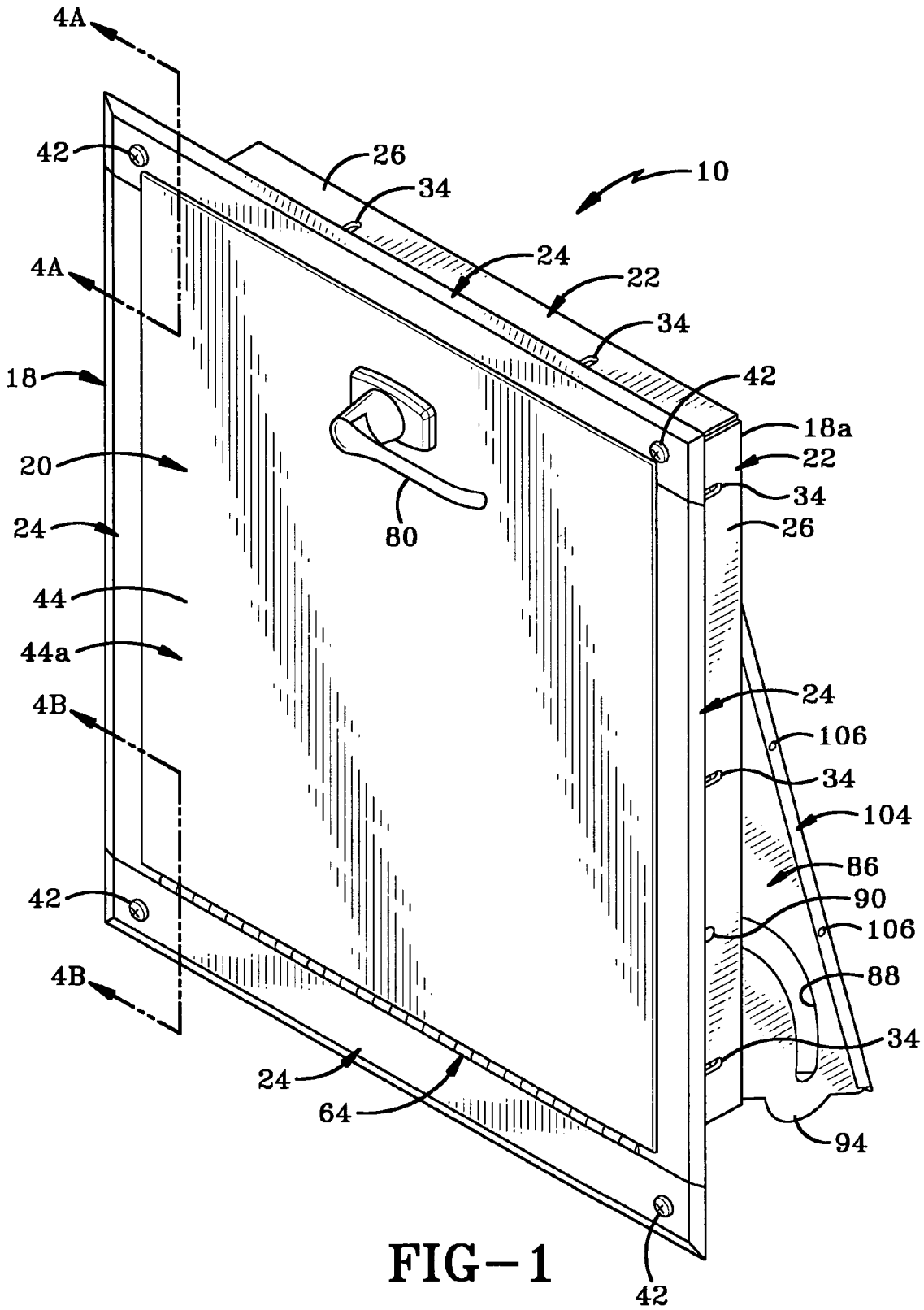
FIG. 1 is a perspective view of the door assembly in accordance with the present invention.
Figure 2:
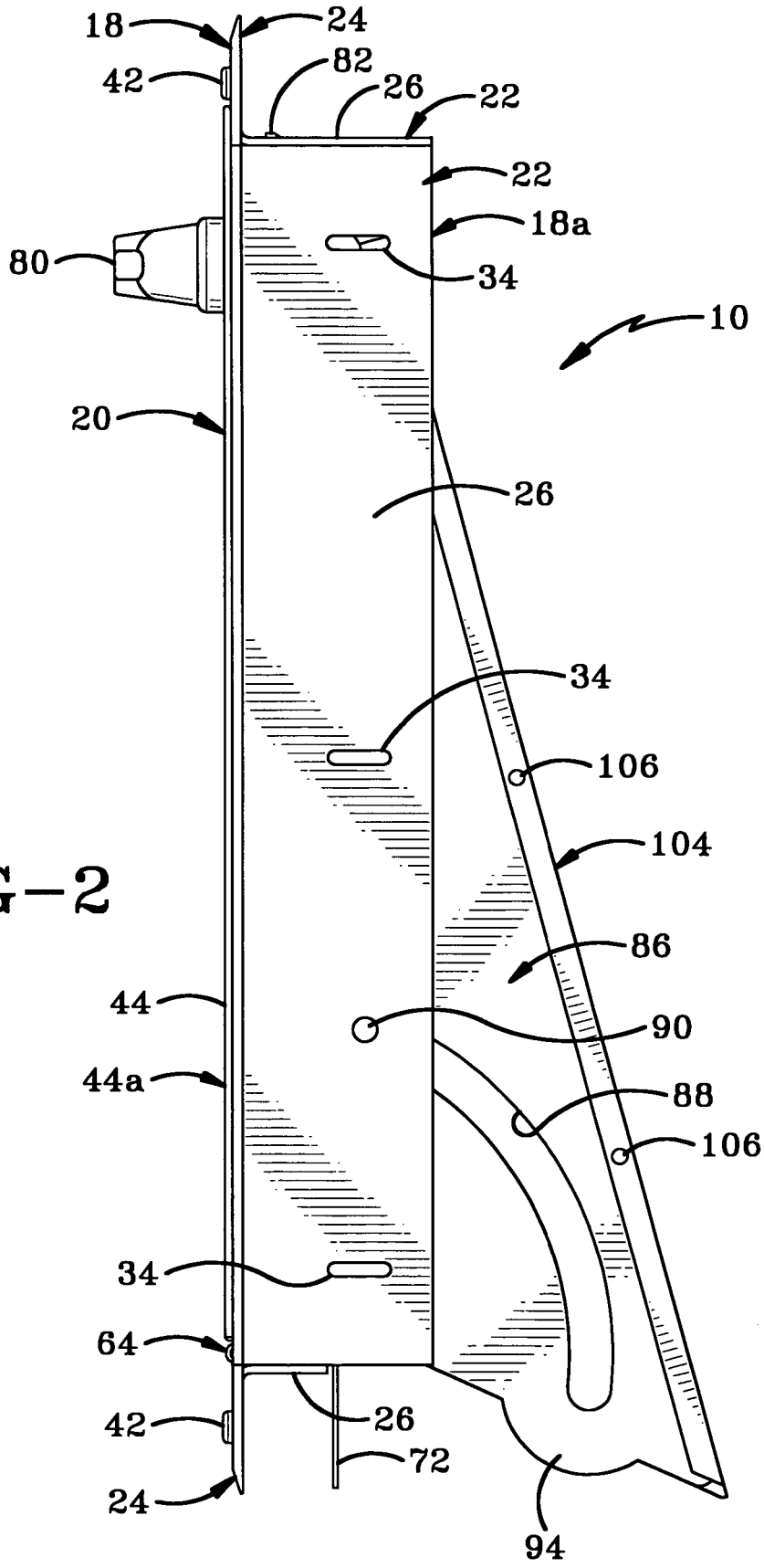
FIG. 2 is a right side view of the door assembly of FIG. 1.
Figure 3:
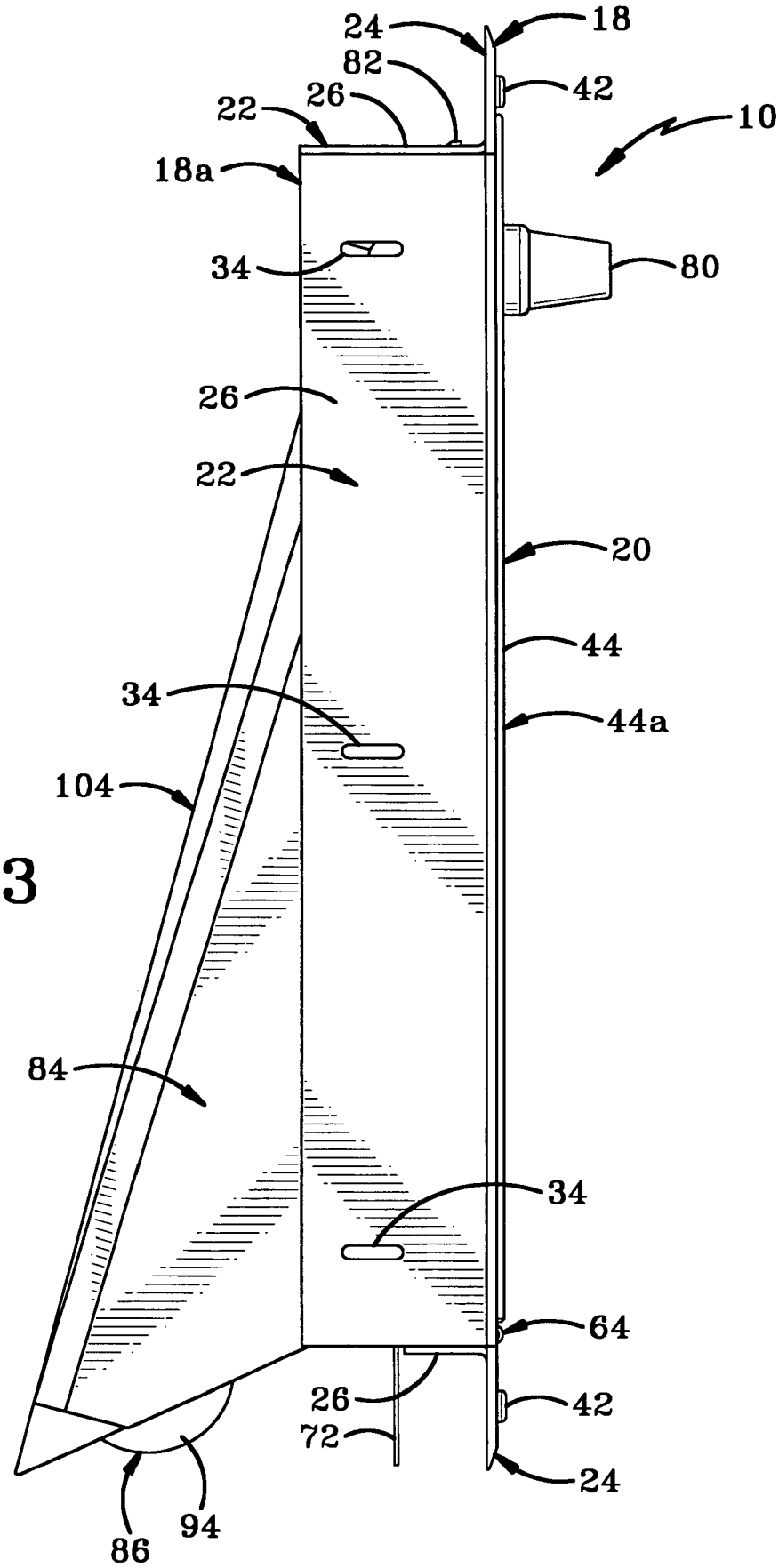
FIG. 3 is a left side view of the door assembly of FIG. 1.

It will be readily understood that the components of the present invention, as generally described and illustrated in the attached figures, could be arranged and designed in a wide variety of different configurations. So, for example, while the door assembly is shown with the door hinged to the frame proximate a bottom end thereof, the door assembly could, alternatively, be hinged proximate its top end or on either one of the left-hand side and right-hand side thereof. Thus, the following detailed description and attached drawings of the invention are not intended to limit the scope of the invention, as claimed, but are merely representative of a preferred embodiment of the apparatus in accordance with the present invention.

The embodiments of the invention will be best understood by reference to the drawings, wherein like parts are designated by like numerals throughout this specification. Those of ordinary skill in the art will, of course, appreciate that various modifications may easily be made without departing from the spirit of the invention.

Referring to FIGS. 1-6 there is shown a door assembly in accordance with the present invention and generally indicated at 10. Door assembly 10 is adapted to selectively allow access to a chute that forms part of a chute system. The chute system is not shown in its entirety, but preferably is of the type typically provided in multi-story buildings where it is desirable to move articles, such as garbage or laundry, easily and efficiently from an upper floor of the building through to a collection area on a lower floor of the building. The chutes in such systems typically include a riser section that runs from the top floor of the building through to the lowest floor of the building and a plurality of throat sections that join the riser at intervals. The riser may be of any size, but typically the risers are in the range of 24-36 inches in diameter. The throat sections are typically around 10 inches deep and extend off the riser at each floor and terminate in an access opening in a building wall. The throat section preferably has an inclined bottom wall so that articles inserted through the opening slide down that bottom wall and drop into the riser. The chute system will typically include an opening on each floor of building. The door assembly of the present invention is installed at said access openings. A collection bin may be positioned beneath a terminal opening in the riser to catch any laundry or garbage bags dropped through one of the openings in a floor remote from the terminal opening.

Door assembly 10 is adapted to be installed around an access opening 14 in a building wall 16. Door assembly 10 comprises a frame assembly 18 onto which a door 20 is pivotally mounted. For the purposes of the present description, FIGS. 6-11 show a portion of a throat section 12 of a chute that terminates in access opening 14. It will be understood, that while the riser is not shown in the attached figures, it lies approximately 8-10 inches beyond the edge 18*a* of frame assembly 18.

In accordance with one of the specific features of the present invention, frame assembly 18 comprises a mounting frame 22 and a trim frame 24 (FIGS. 4A-6). Mounting frame 22 is substantially rectangular in shape and is L-shaped in cross-section having first legs 26 and second legs 28 disposed at substantially ninety degrees to each other. It will be seen from FIG. 7, for example, that the first leg 26*b* of mounting frame 22*b* that is to abut the upper end of opening 14 is longer than the first leg 26*a* of mounting frame 22*a* that is to abut the lower end of opening 14. First legs 26*b* are typically between 1½ inches to 2 inches wide and consequently throat section 12 of chute system terminates approximately 8 inches beyond the end 27 (FIG. 7) of first legs 26*b*. While mounting frame 22 preferably is a single unitary member, it may, alternatively, be made up of more than one separate members. Trim frame 24 is preferably formed from one or more separate members, but could alternatively be formed from a single unitary member.

Mounting frame 22 is positioned so that its respective first legs 26 extend into access opening 14 and are adapted to abut an interior surface 30 of chute 12. The second legs 28 of mounting frame 22 are positioned to abut an exterior surface 32 of wall 16 surrounding opening 14. Each first leg 26 defines a plurality of elongated slots 34 disposed at spaced intervals along the length of that first leg 26. Slots 34 are elongated in shape to allow the position of mounting frame 22 to be adjusted relative to the outermost edge 36 of opening 14. This enables the door assembly 10 to be installed in a correct position even if there are slight variations in the rough construction of wall 16. At least some of first legs 26 are secured to the respective interior surface 30 of chute 12 by way of fasteners 36, such as screws or nails. When first legs 26 of mounting frame 22 are positioned correctly, second legs 28 lie in abutting contact with the exterior surface 32 of wall 16. The members of trim frame 24 are positioned over second legs 28 and in partial abutting contact with exterior surface 32 of wall 16 whereby second legs 28 lie intermediate trim frame 24 and exterior surface 32. Trim frame 24 extends outwardly beyond second legs 28 as may be seen in FIGS. 4A, 4B and 5 and is bent inwardly in order to contact the exterior surface 32 of wall 16. A plurality of fasteners 42 secure trim frame 24 to second legs 28.

Figure 4A:
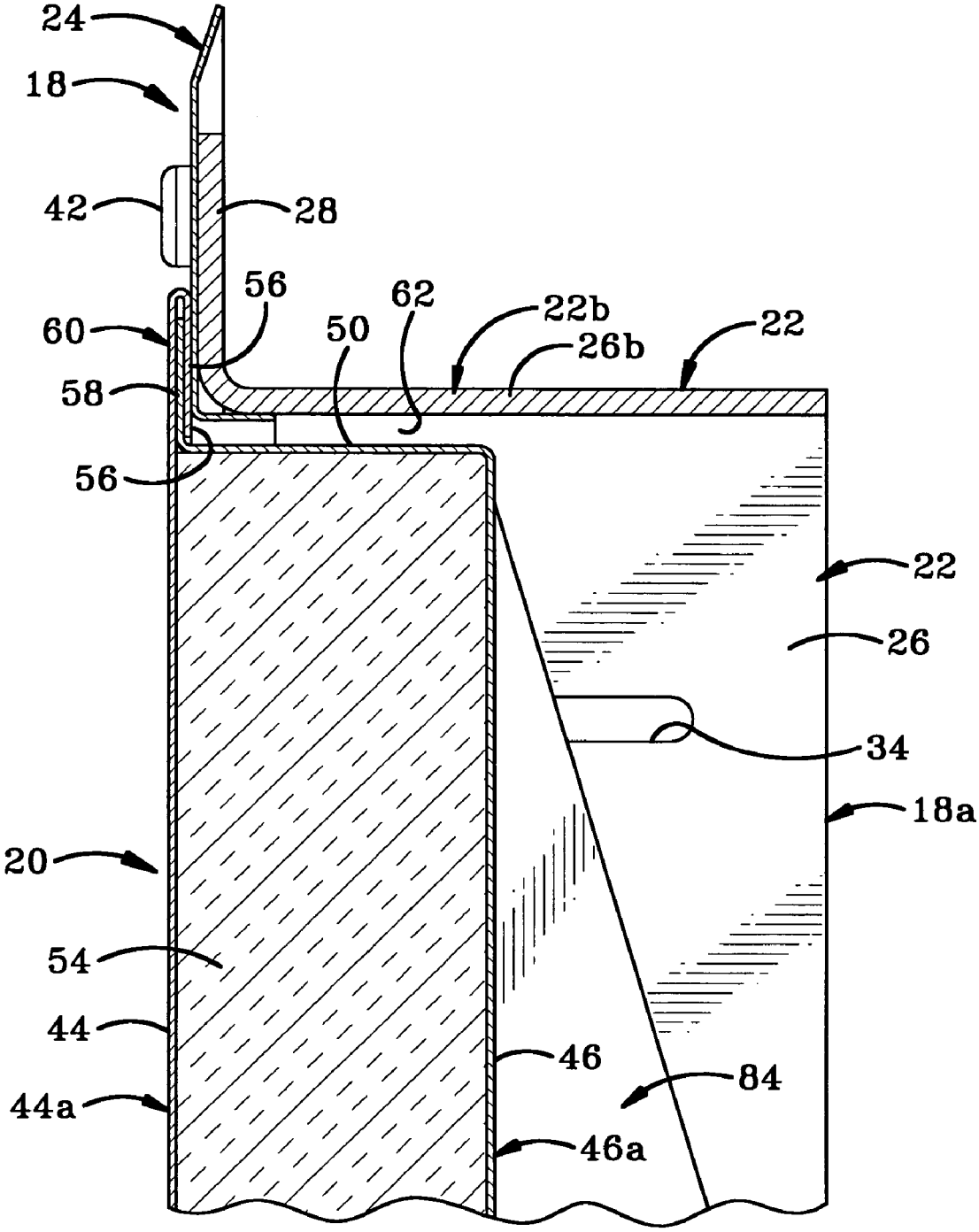
FIG. 4A is a cross-sectional side view of the door assembly through line 4A-4A of FIG. 1.
Figure 4B:
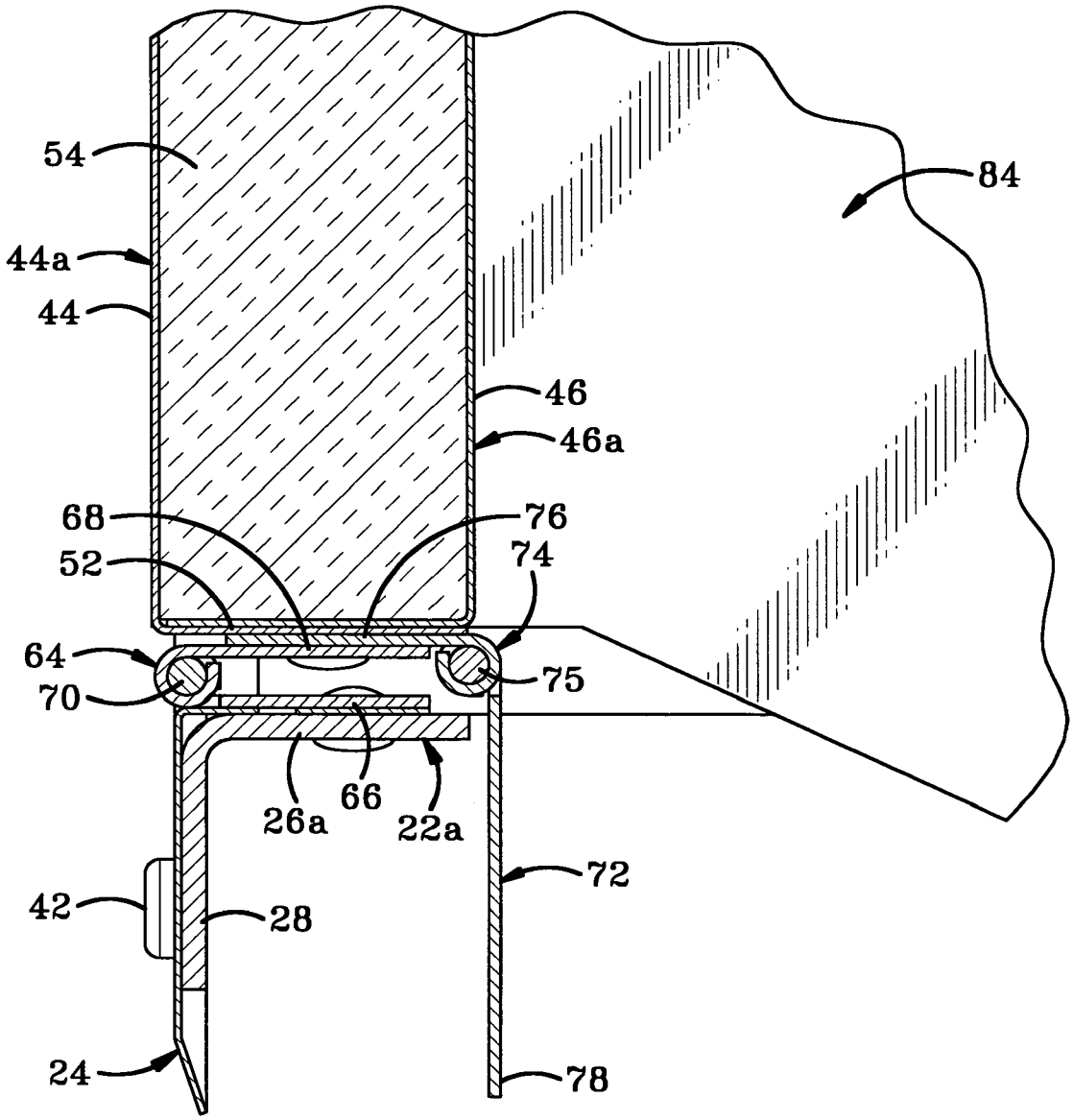
FIG. 4B is a cross-sectional side view of the door assembly through line 4B-4B of FIG. 1.
Figure 5:
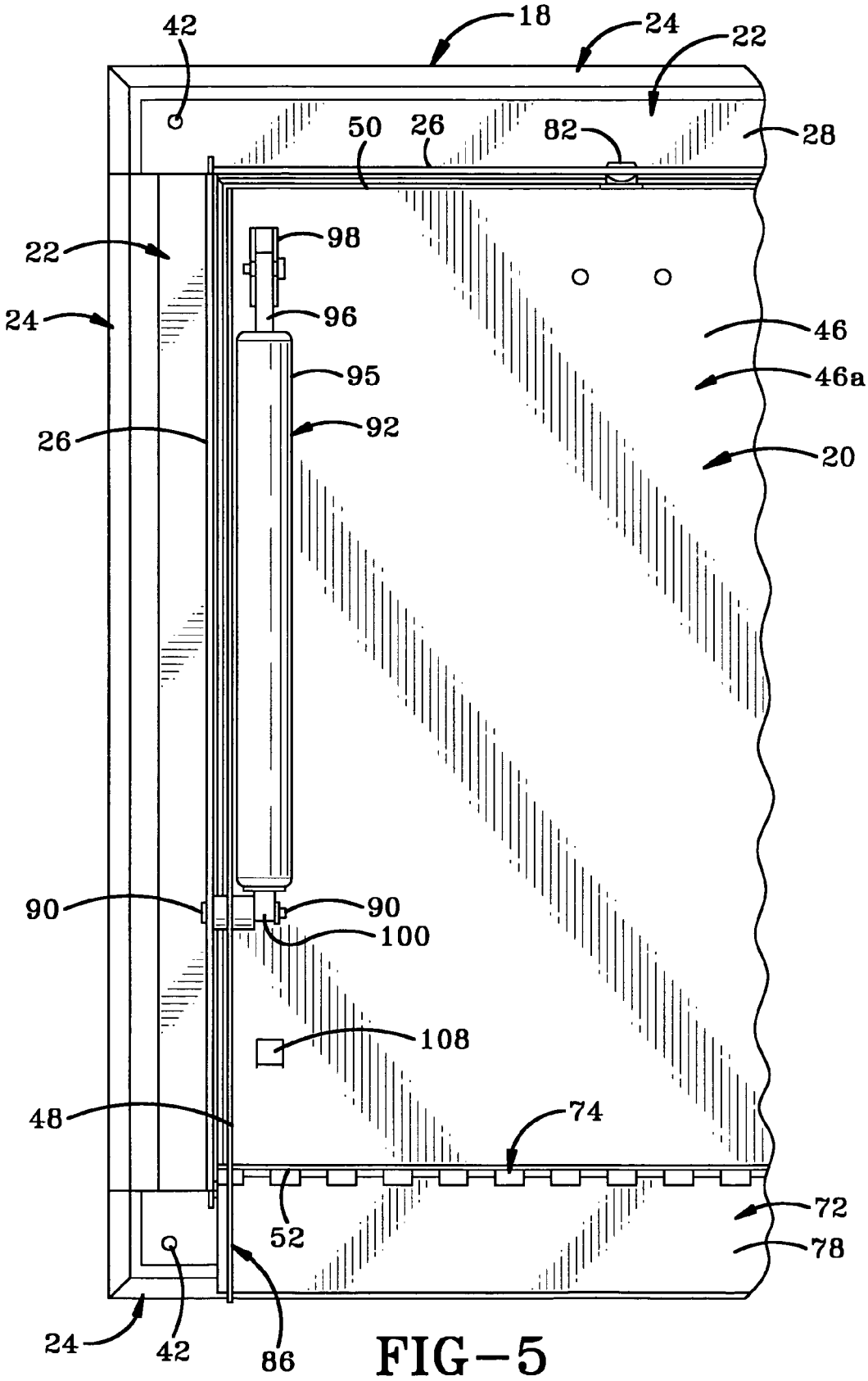
FIG. 5 is a rear view of the door assembly in a closed position with the cover for the automatic closing mechanism removed.

Referring to FIGS. 4A and 4B, and in accordance with a specific feature of the present invention, door 20 preferably is manufactured from two sheets of stainless steel that are mechanically secured together. A peripheral region 56 of the first sheet is bent over and crimped around the peripheral edge 58 of the second sheet so that the door is manufactured substantially free of welds. Door 20 is thereby formed with an exterior wall 44 having an exterior surface 44*a* and an interior wall 46 having an interior surface 46*a*. Disposed between the exterior and interior walls 46, 44, are two opposing side walls 48, a top wall 50 and a bottom wall 52. Top wall 50, bottom wall 52 and side walls 48 are substantially continuous with interior wall 46. At least interior wall 46 of door 20 is formed as a single, substantially continuous sheet of stainless steel that is free of welds. Preferably, the entire door 20 is manufactured in such a manner as to be free of welds. Exterior surface 44*a* may be manufactured with a brushed finish, while interior surface preferably has a shiny finish so as to reduce the possibility for bacteria to accumulate on the surface. A fire resistant or retardant insulating material 54 preferably is sandwiched between exterior and interior surfaces 44, 46.

Figure 6:
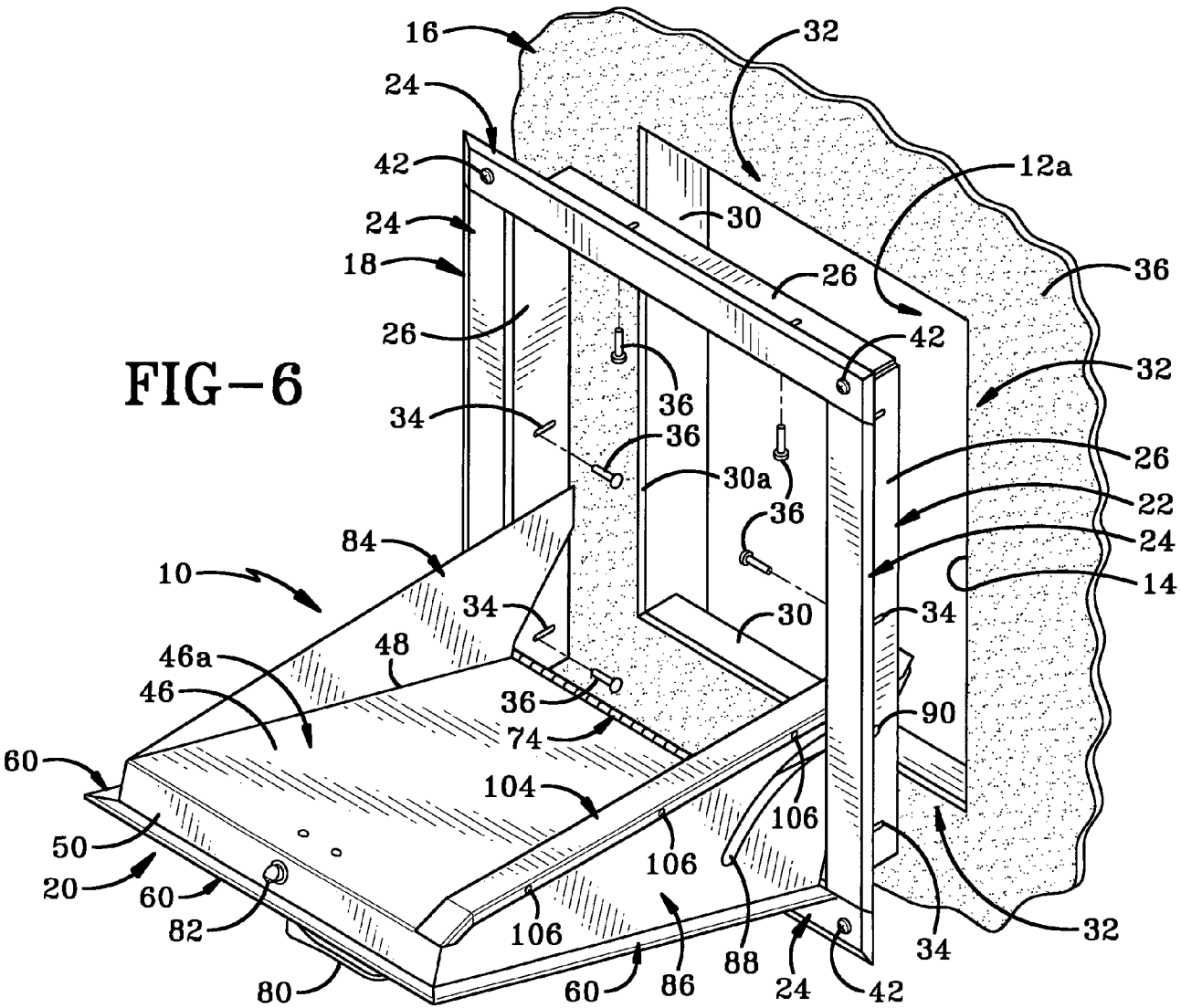
FIG. 6 is a perspective view of the door assembly positioned adjacent an access opening in a wall.
Figure 7:
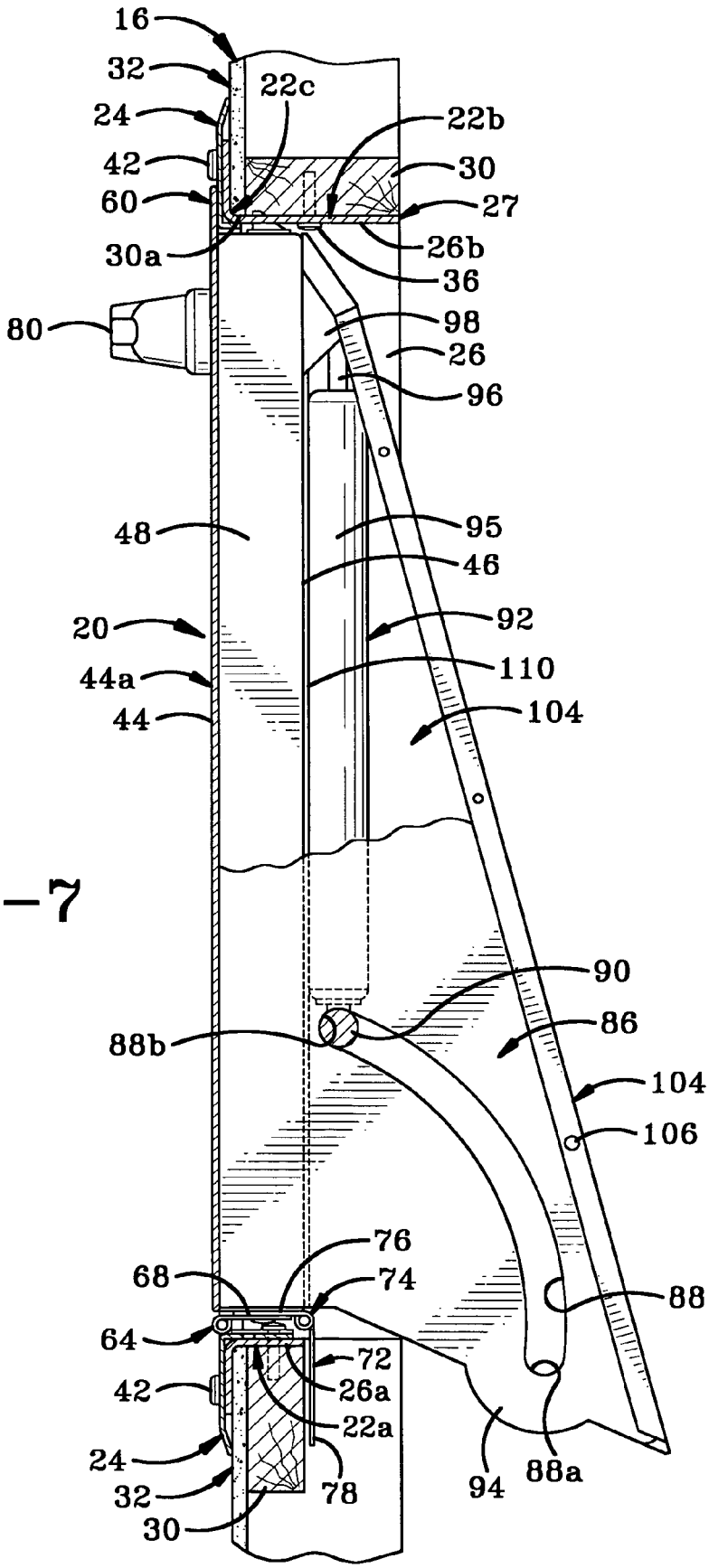
FIG. 7 is a partial cross-sectional right side view of the door assembly mounted in the access opening with the door in a closed position.

The top and sides of exterior surface 44*a* where the two sheets of steel are crimped together thereby form a multi-layered flange 60 that extends outwardly beyond the top wall 50 and side walls 48 of door 20, as can be most easily seen in FIG. 4A and FIG. 6. Flange 60 abuts trim frame 24 and seals the gap 62 formed between top wall 50 of door 20 and first leg 26*b*. This arrangement reduces the possibility that a fire would be transmitted through the chute system from one floor to another. Furthermore, the overlapping of trim frame 24 by flange 60 also tends to reduce any foul smelling odors emanating from garbage moving through the chute system.

Furthermore, although not illustrated in the attached figures, it will be understood that frame assembly 18 may be configured to receive a seal member (not shown) disposed so as to lay intermediate flange 60 and trim frame 24 when door 20 is in a closed position. The seal could be a rubber strip attached to one of the flange 60 and trim frame 24.

Door 20 is pivotally mounted to frame assembly 18 by way of a hinge 64. As may be most easily seen in FIG. 10, a first part 66 of hinge 64 is fixedly secured to frame assembly 18 and a second part 68 of hinge 64 is fixedly secured to bottom wall 52 of door 20. A pivot rod 70 extends through hinge 64 and permits door 20 to be rotatably moved between a closed position (shown in FIGS. 4B & 7) and an open position (shown in FIGS. 8 & 10). Hinge 64 runs substantially the entire width of door 20 but does not extend into flanges 60.

Figure 10:
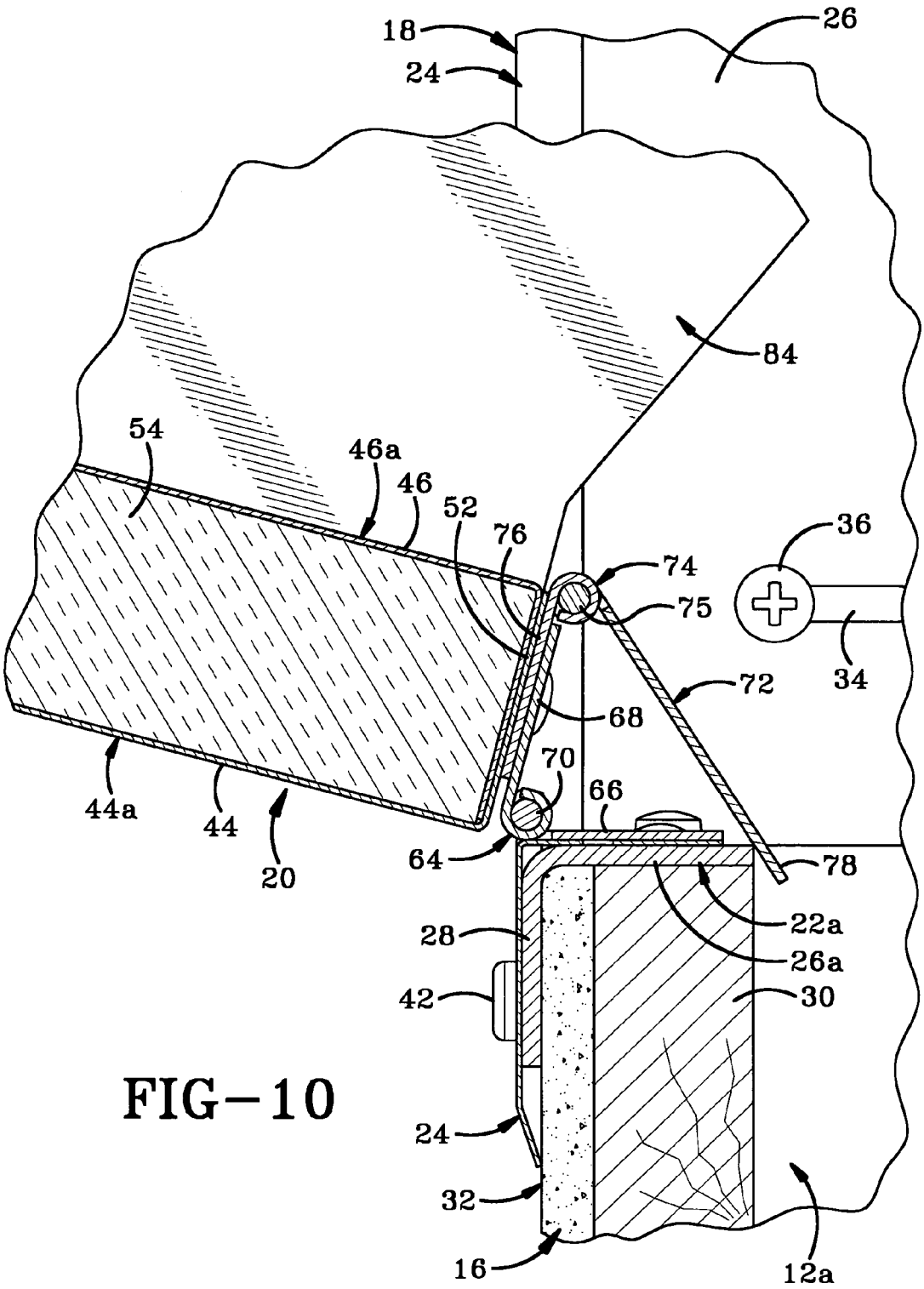
FIG. 10 is an enlarged cross-sectional view of the circled area of FIG. 8.
Figure 11:
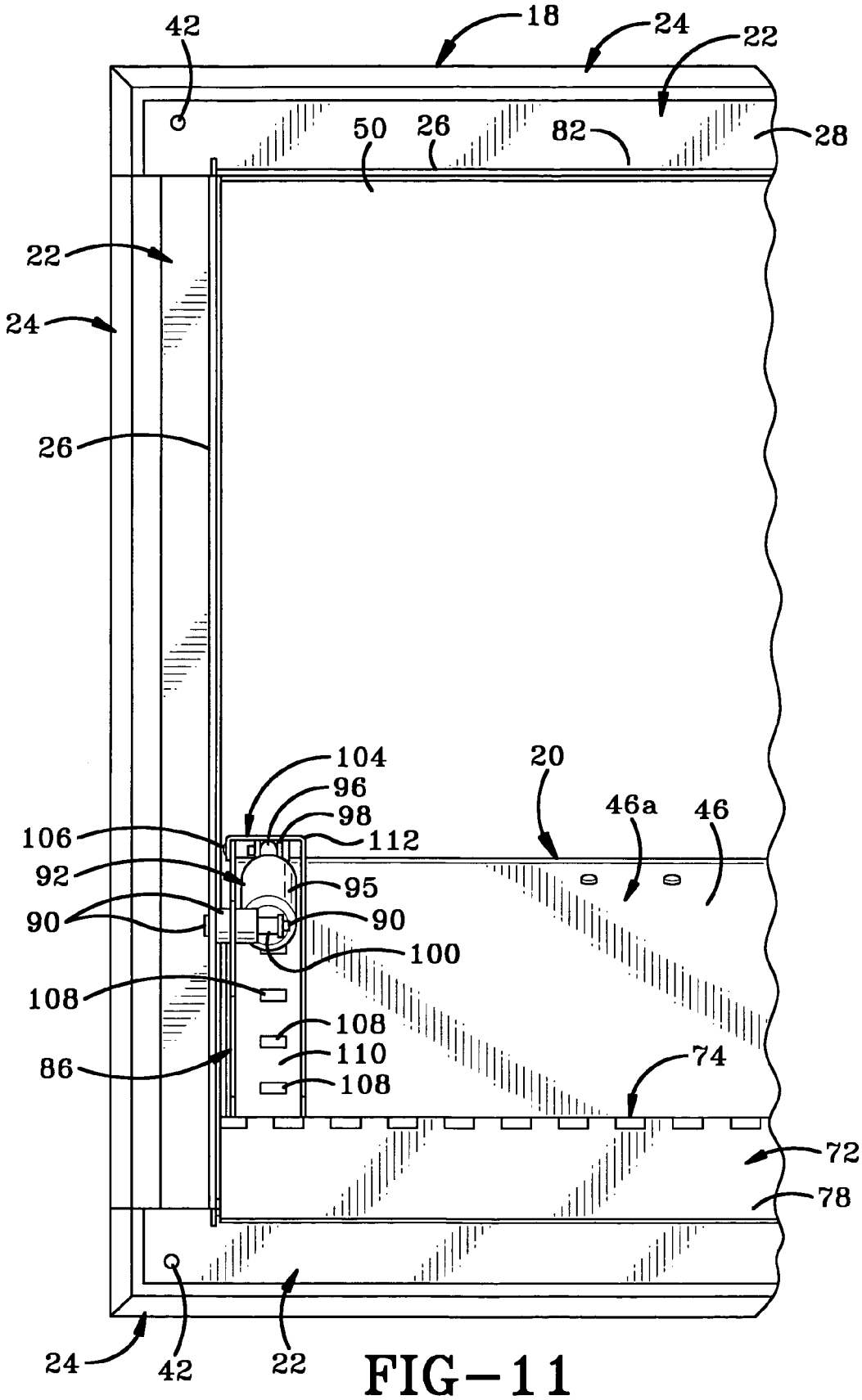
FIG. 11 is a rear view of the installed door assembly with the door in an open position.

In accordance with one of the specific features of the present invention, a second hinge 74 is mounted to door 20 a spaced distance from the hinge 64. Second hinge 74 comprises a substantially L-shaped deflector plate 72 (FIG. 5) mounted for pivotal motion about a second pivot rod 75. As may best be seen from FIG. 6, second hinge 74 runs substantially the entire width of door 20. A first arm 76 of deflector plate 72 is fixedly secured to bottom wall 52 of door 20. A second arm 78 of deflector plate 72 is free of attachment to either the frame assembly 18 or door 20, and rests upon at least a portion of mounting frame 22 and a first part of the chute 12. It will be understood that while first arm 76 of deflector plate 72 is illustrated as laying intermediate bottom wall 52 of door 20 and second part 68 of hinge 64, the second part 68 of hinge 64 could, alternatively, be disposed intermediate first arm 76 of deflector plate 72 and bottom wall 52 of door 20. As door 20 rotates between a closed position and an open position, deflector plate 72 rotates about second pivot rod 75 and second arm 78 substantially remains in contact mounting frame 22 and a first part of chute 12 with as the door pivots between an open and a closed position. Deflector plate 72 thereby continuously covers access to the gap between bottom wall 52 of door and first leg 26 of mounting frame 22. It should be noted from FIG. 7, that the first leg 26*a* of the lower part 22*a* of mounting frame 22, is smaller in width than is the first leg 26*b* of the upper part 22*b* of the mounting frame 22. The mounting frame 22 is shaped in this way to allow second arm 78 of deflector plate 72 to more easily rest on a first part 12*a* of chute 12 and to pivot with door 20. It should also be noted that second arm 78 of deflector plate 72 does not jut out into the interior of the chute 12 when door 20 is closed where it could snag articles that are sliding through the chute system. When door 20 is in its fully open position as shown in FIG. 10, second arm 78 of deflector plate 72 pivots with door 20 and stays resting on frame assembly 18, and more specifically on the narrower width first leg 26*a* of lower part 22*a* of mounting frame 22. Once again, second arm 78 does not extend substantially outwardly into the throat section of chute 12 and therefore articles being inserted through access opening 14 do not become snagged on deflector plate 72. Furthermore, articles traveling through the riser section of the chute do not engage second arm 78. Deflector plate 72 therefore continuously covers hinge 64 and substantially prevents laundry or debris from garbage inserted through opening 14, from coming into contact with hinge 64. The possible accumulation of garbage in the gap between the bottom of door 20 and frame member 22 and the consequent loss of operation of hinge 64 is therefore substantially reduced.

Door 20 is further provided with a handle 80 and latching mechanism (not shown). Any suitable type of latching mechanism may be utilized on door 20. In the preferred embodiment illustrated in FIGS. 1 and 6, handle 80 is fastened to door 20 through both interior and exterior surfaces 46, 44 and a latch 82 of the latching mechanism extends outwardly from top wall 50 of door 20 and is adapted to engage in a recess (not shown) in frame assembly 18. Handle 80 provides an easy and convenient way for a person to open and close door 20 and may also be of a type that specifically addresses the needs of the elderly or the physically challenged. The latching mechanism allows a person to unlatch door 20 so that access can be gained to opening 14 and chute 12. When the person has deposited their garbage, laundry or other appropriate articles into chute 12, then latch 82 will be engaged to secure door 20 in the closed position so that the seal is maintained between trim frame 24 and flange 60.

In accordance with another specific feature of the present invention, a chute guide 84 may extend outwardly away from interior surface 46*a* of door 20. As implied, chute guide 84 helps direct articles such as garbage bags and laundry through opening 14 and into chute 12. Although not illustrated in the attached drawings, chute guide 84 can also include a formed edge or additional hardware to serve as a stop to the opening angle of the door 20. Chute guide 84 preferably is also manufactured from stainless steel.

A stop plate extends outwardly away from interior surface 46*a* and from proximate the opposite side wall 48 of door 20 from chute guide 84. Stop plate 86 defines an arcuate slot 88 through which a slide rod 90 passes. Slide rod 90 is fixedly attached at one end to a first leg 26 of one of mounting frame 22. Slide rod 90 is mounted at the other end to an automatic door closer 92 as will be hereinafter described. Stop plate 86 preferably includes a reinforcing area 94 disposed proximate an end of slot 88 so that slide rod 90 does not damage slot 88 when door 20 is opened and closed. Reinforcing area may be semicircular or angular in shape.

As mentioned above and shown in FIG. 8, the automatic door closer 92 is mounted on interior surface 46*a* of door 20. In the preferred embodiment of the invention, door closer 92 comprises a cylinder 95 that houses a mechanical coil spring with hydraulic dampening fluid therein or, alternatively, a gas spring. The spring (not shown) within cylinder 95 urges closer 92 to a more compressed condition. A piston rod 96 extends outwardly from a first end of cylinder 95 and is pivotally connected to a mounting bracket 98 extending from interior surface 46 of door 20. The other end of closer 92 is pivotally connected via a mounting ring 100 to the slide rod 90, which is in turn rigidly connected to the adjacent mounting frame 22. Closer 92 ensures that flange 60 of door 20 lies in abutting contact with trim frame 24 thereby reducing the chances of flames or smoke from a fire spreading through the chute system. Closer 92 also has spring and dampening properties such that it will not allow door 20 to close with a hard slamming motion. Closer 92 is mounted adjacent stop plate 86 so that it is out of the way when articles are inserted into opening 14 and therefore does not tend to obstruct opening 14. Slide rod 90 provides both a means for mounting closer 92 and for contacting the end 88*a* (FIG. 8) of slot 88 to limit the travel of door 20. This limit is redundant to the maximum extension of closer 92.

A removable cover 104 for closer 92 is secured to stop plate 86 by way of a plurality of fasteners 106. In accordance with one of the specific features of the present invention, both stop plate 86 and closer 92 are also manufactured from stainless steel. A plurality of interlocking tabs 108 (FIG. 5) are provided on interior surface 46*a* of door 20 to provide securing points for the base 110 of cover 104. As may be seen from FIG. 11, cover 104 is shaped and sized to fit tightly over closer 92 so that closer 92 is disposed between the vertical walls of stop plate 86 and cover 104. Cover 104 thereby protects closer 92 by substantially preventing articles inserted through opening 14 from coming into contact with closer 92. Furthermore, cover 104 is as compact as possible so that the least amount of room is taken up by the closer 92 and cover 104. This reduces the amount of interference that these components present to articles being inserted through opening 14. When door 20 is in the open position shown in FIG. 9, fasteners 106 can be removed so that cover 104 can be removed. Cover 104 is released from tabs 108 on door 20 by sliding cover 104 in a direction opposite to the direction that the free ends of the tabs 108 extend. Cover 104 is removed so that maintenance can be performed upon closer 92.

It will be understood that stop plate 86, closer 92 and cover 104 can be placed on either side or, in larger doors on both sides, of the interior surface 46*a* of door 20. Furthermore, it will be understood that chute guide 84 can be completely omitted from door assembly 10 to facilitate access to opening 14. Additionally, if hinge 64 is provided in a position other than mounted at the bottom of door 20, then stop plate 86, closer 92 and cover 104 will be positioned appropriately for the door to function properly.

Referring to FIGS. 7-11 and presuming that opening 14 has been cut into wall 16 and the chute system is already installed in building, door assembly is installed as follows. Mounting frame 22 is installed into opening 14 by generally positioning mounting frame 22 so that an outermost edge 30*a* of wall 16 lies within the apex 22*c* (FIG. 4A) of the first and second legs 26, 28 of mounting frame 22. Fasteners 36 are loosely inserted through slots 34 in first legs 26 of mounting frame 22, thus loosely holding mounting frame against interior surface 30 of chute 12. The position of mounting frame 22 can then be adjusted by sliding frame 22 relative to fasteners 36. When mounting frame 22 is in the correct position, fasteners 36 are tightly secured into place. Once mounting frame 22 is installed in opening 14, the members of trim frame 24 are positioned over second legs 28 of mounting frame 22 and in abutting contact with at least a portion of exterior surface 32 of wall 16 surrounding opening 14. Fasteners 42 are then used to secure trim frame 24 to second legs 28 of mounting frame 22. Door 20 is secured, by hinge 64 to the selected one of the top, bottom and side portions of mounting frame 22 to allow door 20 to open in the desired direction. Care must be taken to ensure that flange 60 on door 20 overlaps trim frame 24 to a sufficient degree to ensure that chute opening 14 is adequately sealed when door 20 is in the closed position. The installer installs a cooperating latching mechanism on door 20 and mounting frame 22 and installs deflector plate 72 to cover hinge 64 if these components have not been previously installed on door 20. Furthermore, if the automatic closer 92 has not been previously installed on interior surface 46*a* of door 20, then closer 92 may be mounted thereon at this point by securing the piston rod 96 to bracket 98. The other end of cylinder 95 is connected to slide rod 90. Cover 104 is then secured over closer 92.

Figure 8:
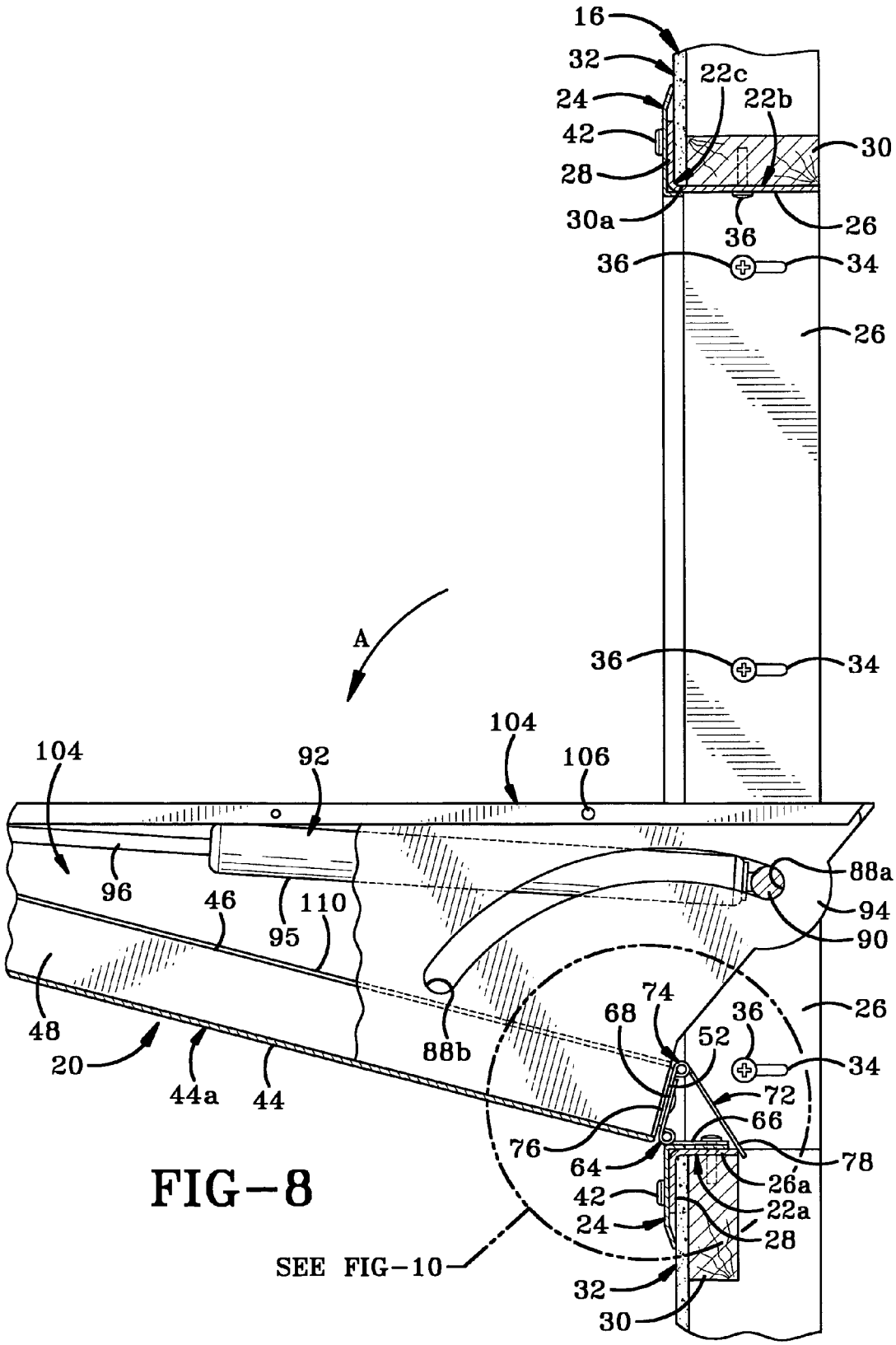
FIG. 8 is partial cross-sectional right side view of the door assembly mounted in the opening with the door in an open position.
Figure 9:
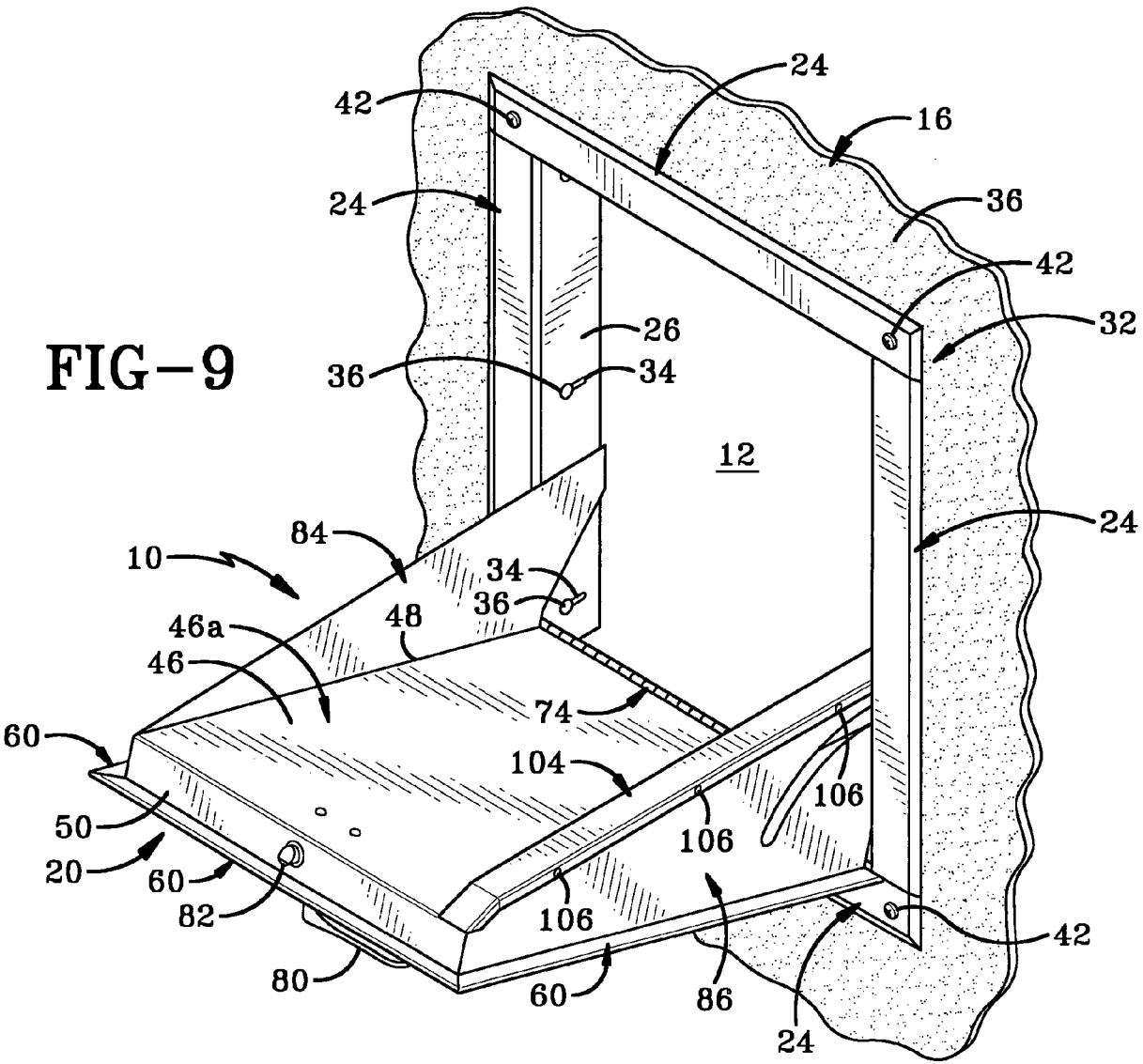
FIG. 9 is a perspective view of the door assembly mounted around the access opening in the wall and showing the door in an open position.

When a building occupant wants to open door assembly 10 to dispose of a bag of garbage, for instance, they grasp handle 80 and either depress a button or turn the handle (depending on the type of handle installed) to disengage latch 82 from frame assembly 18. The person pulls door 20 downwardly in the direction of arrow "A" (FIG. 8). This causes door 20 to rotate about pivot rod 70, forcing piston rod 96 to be drawn out of cylinder 95, causing slide rod 90 to slide along arcuate slot 88. As door 20 rotates, deflector plate 72 pivots about pivot rod 75 from the position shown in FIG. 7 to the position shown in FIG. 9. As may be seen, deflector plate 72 continuously covers hinge 64 during this opening motion. When slide rod 90 reaches end 88*a* of slot 88, the opening motion of door 20 stops. The person can then push a bag of garbage (not shown) or an article of clothing, depending on the use of the chute system, through opening 14. The bag is released into chute 12 and drops through the chute system under the action of gravity. Because closer 92 and cover 104 are as small as possible and are positioned off to one side of the interior surface 46*a* of door 20, they do not substantially prevent or hinder the insertion of the bag of garbage into chute 12. It should also be noted that the uppermost corners 112 (FIG. 11) of cover 104 are rounded to prevent snagging of the bag of garbage thereon. However, should the bag break open for some reason, the interior surface 46*a* of door 20 is free of welds, is made of stainless steel and is provided with a shiny external surface. This prevents any small bits of garbage from collecting in cracks and crevices in interior surface 46*a* of door. Furthermore, because deflector plate 72 continuously covers hinge 64 and the gap formed between the bottom wall 52 of door and first leg 26*a* of mounting frame 22*a* (FIG. 10), no small bits of garbage and debris can accumulate in that gap. This reduces the possibility of contamination of door 20 and ensures that door 20 can open and close properly because debris does not fall between bottom wall 52 and mounting frame 22*a*. Once the bag of garbage has been released into chute 12, the person can let go of handle 80 and automatic closer 92 will cause the door to close by itself. This is accomplished because piston rod 96 automatically returns to its retracted position inside cylinder 95, causing door to rotate in the opposite direction to arrow "A" (FIG. 8). As this occurs, arcuate slot 99 slides past slide rod 90 until slide rod 90 is disposed proximate the second end 88*b* of slot 88. Latch 82 slides back into the cooperating recess (not shown) in mounting frame 22 and flange 60 is thereby held in abutting contact with trim frame 24, thereby sealing door 20 to frame assembly 18.

It will be understood by those skilled in the art that door 20 can be provided with a hinge mechanism on any one of the top wall 50, bottom wall 52 and one or the other of side walls 48 without departing from the spirit of the present invention. When door 20 is hinged differently, it can be opened upwardly, downwardly or to one of the left and right sides as is required by the chute system which it is designed to cover.

The present invention may be embodied in other specific forms without departing from the spirit of the invention. The described embodiments are to be considered in all respect only as illustrative, and not restrictive. The scope of the invention is, therefore, indicated by the appended claims, rather than by the foregoing description. All changes within the meaning and range of equivalency of the claims are to be embraced within their scope.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A door assembly for closing an access opening to a chute of a chute system and selectively allowing access thereto, the door assembly comprising:

a frame assembly adapted to be disposed about the access opening of the chute system;

a door pivotally mounted to the frame, the door having an exterior surface and an interior surface;

an automatic door closer mounted on the interior surface of the door; the door closer being connected at a first end to the interior surface of the door and at a second end to the frame assembly; and wherein the automatic closer moves into the access opening when the door is closed and out of the access opening when the door is opened.

2. The door assembly as defined in claim 1, further comprising a stop plate mounted on the door and extending away from the interior surface thereof.

3. The door assembly as defined in claim 2, wherein the automatic closer is mounted on the interior surface of the door proximate the stop plate.

4. The door assembly as defined in claim 3, further comprising a cover removably secured to at least one of the stop plate and the interior surface of the door, said cover being disposed over the automatic closer.

5. The door assembly as defined in claim 4, wherein the chute includes a throat portion and riser portion and the at least one of the automatic closer and cover does not extend into the riser portion of the chute when the door is in a closed position.

6. The door assembly as defined in claim 3 wherein the automatic closer comprises one of a mechanical coil spring with dampening hydraulic fluid and a gas spring.

7. The door assembly as defined in claim 6, wherein the automatic closer has a first end and a second end; and wherein the first end of the automatic closer is attached to the interior surface of the door and the second end thereof is attached to the frame assembly.

8. The door assembly as defined in claim 1, further comprising a chute guide extending outwardly from the interior surface of the door; and wherein the chute guide is adapted to direct articles into the access opening of the chute system.

9. The door assembly as defined in claim 1, wherein the door includes an interior wall and an exterior wall; and the exterior surface of the door is on the door's exterior wall and the interior surface of the door is on the door's interior wall; and wherein the door assembly further comprises side walls that extend between the door's exterior and interior walls; and the exterior, interior and side walls of the door are mechanically secured together; whereby the door is substantially free of welds.

10. The door assembly as defined in claim 9, wherein the exterior wall, interior wall and side walls of the door are manufactured from stainless steel.

11. The door assembly as defined in claim 9, further comprising a stop plate and chute guide mounted proximate opposing side walls of the door, the stop plate and chute guide extending away from the interior surface of the door; and wherein the stop plate and chute guide are manufactured from stainless steel.

12. The door assembly as defined in claim 9, further comprising a fire retardant material disposed between the door's interior and exterior walls.

13. The door assembly as defined in claim 9, wherein the door exterior wall has a first end proximate a hinge and a second end remote from the hinge, and wherein the door's interior and side walls are mechanically secured to the door's exterior wall so as to form a flange that extends outwardly beyond the second end of the door to form a lip; and wherein the lip extends at least partially over the frame assembly when the door is in a close position.

14. The door assembly as defined in claim 13, wherein the flange is coplanar with the exterior wall of the door.

15. The door assembly as defined in claim 1, wherein the frame assembly includes a mounting frame that is substantially L-shaped in cross-section, having first legs that are adapted to be received within the access opening of the chute system and to be secured to an interior surface of the chute; and second legs that are adapted to abut an exterior surface of the wall surrounding the access opening.

16. The door assembly as defined in claim 15, wherein the first legs of the mounting frame include a plurality of spaced-apart elongated slots adapted to receive fasteners therethrough to connect the mounting frame to the interior surface of the chute.

17. The door assembly as defined in claim 15, wherein the frame assembly further includes a trim frame; and wherein the trim frame is secured to the mounting frame so that the second legs of the mounting frame are disposed between the trim frame and the exterior surface of the wall.

18. The door assembly as defined in claim 1, further comprising a second automatic closer mounted on the interior surface of the door and being connected at a first end to the interior surface of the door and at a second end to the frame assembly.

19. The door assembly as defined in claim 1, wherein the automatic closer does not intrude into a riser of the chute system when the door is in a closed position.

20. The door assembly as defined in claim 2, further comprising a slide rod extending outwardly from the frame assembly; and wherein the engagement of the slide rod with the stop plate limits the extent to which the door may be opened.

21. The door assembly as defined in claim 20, wherein the automatic closer is mounted at a first end to the interior surface of the door and at a second end to the slide rod.

22. The door assembly as defined in claim 21, wherein the automatic closer is one of a mechanical coil spring with dampening hydraulic fluid and a gas spring.

23. The door assembly as defined in claim 11, further comprising a second chute guide disposed proximate the stop plate and inwardly of the same; whereby articles to be sent through the chute pass between the chute guide and the second chute guide; and wherein the automatic closer is disposed between the second chute guide and the stop plate.

24. A door assembly for closing an access opening to a chute of a chute system and selectively allowing access thereto, the door assembly comprising:

a frame assembly adapted to be disposed about the access opening of the chute system;

a door pivotally mounted to the frame assembly, the door having an exterior surface and an interior surface;

a stop plate mounted on the door and extending away from the interior surface thereof;

an automatic door closer mounted on the interior surface of the door proximate the stop plate; said automatic closer being one of a mechanical coil spring with dampening hydraulic fluid and a gas spring; and wherein a first end of the automatic closer is attached to the interior surface of the door, and a second end thereof is attached to the frame assembly; and wherein the stop plate defines an arcuate slot therein and the door assembly further comprises a slide rod disposed proximate the second end of the automatic closer; and the slide rod extends through the arcuate slot in the stop plate and is secured to the frame assembly; and wherein movement of the door between an open position and a closed position causes relative movement between the slide rod and the stop plate.

25. A door assembly for closing an access opening to a chute of a chute system and selectively allowing access thereto, the door assembly comprising:

a frame assembly adapted to be disposed about the access opening of the chute system;

a door pivotally mounted to the frame, the door having an exterior surface and an interior surface; wherein the door is connected to the frame assembly by a first hinge;

an automatic door closer mounted on the interior surface of the door; the automatic closer being connected at a first end to the interior surface of the door and at a second end to the frame assembly; and a deflector plate mounted on the door proximate the first hinge; whereby the first hinge is substantially covered by the deflector plate when the door is in the open position.

26. The door assembly as defined in claim 25, wherein the first hinge has a length and the deflector plate covers substantially the entire length of the first hinge.

27. The door assembly as defined in claim 25, wherein the deflector plate comprises a free end of a second hinge, said second hinge being secured at a first end to the door; and wherein the deflector plate rests upon at least a portion of one of the mounting frame and a first part of the chute and substantially remains in contact therewith as the door pivots between an open and a closed position.

* * * * *